US005125127A

United States Patent [19]

Bach et al.

[11] Patent Number: 5,125,127

[45] Date of Patent: Jun. 30, 1992

[54] HOLDING DEVICE ON AN ELECTRICAL VACUUM CLEANER

[75] Inventors: Orest Bach, Weisbaden; Gerald Resch, Rodgau, both of Fed. Rep. of Germany

[73] Assignee: Rowenta-Werke GmbH, Offenbach am Main, Fed. Rep. of Germany

[21] Appl. No.: 609,369

[22] Filed: Nov. 5, 1990

[30] Foreign Application Priority Data

Nov. 15, 1989 [DE] Fed. Rep. of Germany ... 8913502[U]

[51] Int. Cl.[5] ..... A47L 9/00

[52] U.S. Cl. ..... 15/323; 248/225.2

[58] Field of Search ..... 15/323, 339, 336; 211/126, 192; 248/225.2, 221.2, 243

[56] References Cited

U.S. PATENT DOCUMENTS

| | | | |
|---|---|---|---|
| 2,570,346 | 10/1951 | Hoover | 15/323 |
| 3,509,590 | 5/1970 | Koshiyama | 15/323 |
| 3,637,086 | 1/1972 | Klein | 211/192 |
| 4,467,493 | 8/1984 | Buchtel | 15/339 |
| 4,545,089 | 10/1985 | Oxel | 15/323 |
| 4,679,368 | 7/1987 | Pettinga et al. | 248/225.2 |
| 4,697,299 | 10/1987 | Brinkhoff et al. | 15/323 |
| 4,789,071 | 12/1988 | Larsson | 211/192 |
| 4,835,814 | 6/1989 | Bonnet | 15/339 |

FOREIGN PATENT DOCUMENTS

| | | | |
|---|---|---|---|
| 0895125 | 3/1944 | Fed. Rep. of Germany | 15/323 |
| 3529133 | 2/1987 | Fed. Rep. of Germany | 15/339 |
| 2128075 | 4/1984 | United Kingdom | 15/323 |

*Primary Examiner*—Harvey C. Hornsby
*Assistant Examiner*—James F. Hook
*Attorney, Agent, or Firm*—Akoo-Toren

[57] ABSTRACT

An electrical vacuum cleaner, including a vacuum cleaner housing, a suction tube nozzle unit, a suction hose, a suction tube and a suction nozzle, and a retaining arrangement for the suction tube nozzle unit which is provided on the vacuum cleaner housing, the retaining arrangement including a pivotable retaining clip for the suction tube and a retaining recess for a hook mounted on at least one of the suction tube and the suction nozzle, a spring arm movably mounted on an inner wall of the vacuum cleaner housing, the spring arm being hinged, at one end, to the retaining clip, its other end being operatively connectable to the hook in the region of the retaining recess, and a resiliently deformable holder mounted on the spring arm substantially at right angles to a direction of movement, the spring arm and the holder having a recoil force which is less than a force exerted by the hook on the spring arm.

4 Claims, 4 Drawing Sheets

20
20'
8
2
11
20'
5
15
9
14
10
2
13
6
17
17
19
19'
16
19'
19
7
18
12

HOLDING DEVICE ON AN ELECTRICAL VACUUM CLEANER

BACKGROUND OF THE INVENTION

The invention relates to an electrical vacuum cleaner having a suction tube nozzle unit, consisting of a suction hose, suction tube and suction nozzle and retaining means for the suction tube nozzle unit mounted on the housing of the vacuum cleaner. The retaining means includes a pivotable retaining clip for the suction tube and a retaining pouch for a hook mounted on the suction tube and/or on the suction nozzle.

Retaining means of this kind are known from DE-GM 85 21 945. The retaining means have a hook provided on the suction tube which engages in a retaining pouch formed in the wall of the vacuum cleaner housing and a pivotable retaining clip mounted at a spacing from the retaining pouch on the housing wall and clipping the suction tube in position in the engaged state. When the suction tube is removed from the retaining slip, the latter is released from its position of engagement and is subsequently pivoted, by a force acting on the retaining clip, into a recess formed in the housing of the vacuuming cleaner.

In order to attach the suction tube, the retaining clip has to be laboriously pivoted out of the recess by hand. This encompasses a risk of injury to the hand and more particularly the fingernails may be broken or torn.

SUMMARY OF THE INVENTION

Starting from this known prior art, it is an object of the present invention to provide retaining means for the suction tube nozzle unit on the housing of a vacuum cleaner which does not have the disadvantages described above, and in which the retaining clip automatically pivots out of the resting position in the vacuum cleaner housing and into its operating position or pivots back into its resting position.

This means that when the user breaks off from vacuum cleaning or puts away the vacuum cleaner having the retaining means according to the invention for connecting the suction tube nozzle unit to the vacuum cleaner housing, the retaining clip does not have to be pivoted by hand out of the recess in the vacuum cleaner housing into the operating position, with the result that there is no danger of consequent injury to the hand or breaking of the fingernails.

When the hook mounted on the suction nozzle or on the suction tube is inserted into the retaining pouch provided on the vacuum cleaner housing, the hook becomes effectively connected to the spring arm according to the invention. The spring arm, which is attached to the vacuum cleaner housing so as to be movable along the inner wall of the vacuum cleaner housing parallel to the housing wall, is moved by the force exerted on one end of the spring arm by the hook. A resiliently deformable holder is corrected between the one end of the spring arm and the housing so as to be tensioned by this movement of the spring arm. The other end of the spring arm is hinged to the retaining clip. When the hook engages in the retaining pouch, the retaining clip is pivoted into its operating position by means of the spring arm. When the suction tube nozzle unit is uncoupled and the hook is removed from the retaining pouch, the effective connection between the hook and the spring arm is broken. The cessation of the force exerted by the hook on the spring arm frees the tension force of the spring arm and holder. The spring arm moves back into its starting position and at the same time pivots the retaining clip hinged thereto into the resting position.

Advantageously, the resilient deformable holder mounted on the spring arm is secured to the spring arm substantially at right angles to the direction of movement of the latter. A cam is expediently formed on ends of the holder which engages in an eyelet formed on the vacuum cleaner housing so that the ends of the holder are fixed in the housing while the central portion of the holder, which is connected to the spring arm, is movable with the spring arm. This movement of the central portion of the holder provides the aforementioned tension. As a result of its resilience, the holder additionally backs up the recoil force of the spring arm.

According to the invention, the spring arm consists of two plates and at least one spring. Advantageously, the spring arm is made in one piece from a resilient deformable plastic material. Compared with a spring arm of rigid construction, the spring arm according to the invention has the advantage that unexpected or inadvertent tensile forces, such as impacts, acting on the spring arm are equalized by the spring, thereby preventing breakage of the spring arm if it is handled incorrectly.

In a further embodiment of the invention, the end of the spring arm which engages in the retaining pouch is provided with a press key which increases the surface area of the spring arm in the area of engagement of the hook and thereby improves the actuation of the spring arm by the hook.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
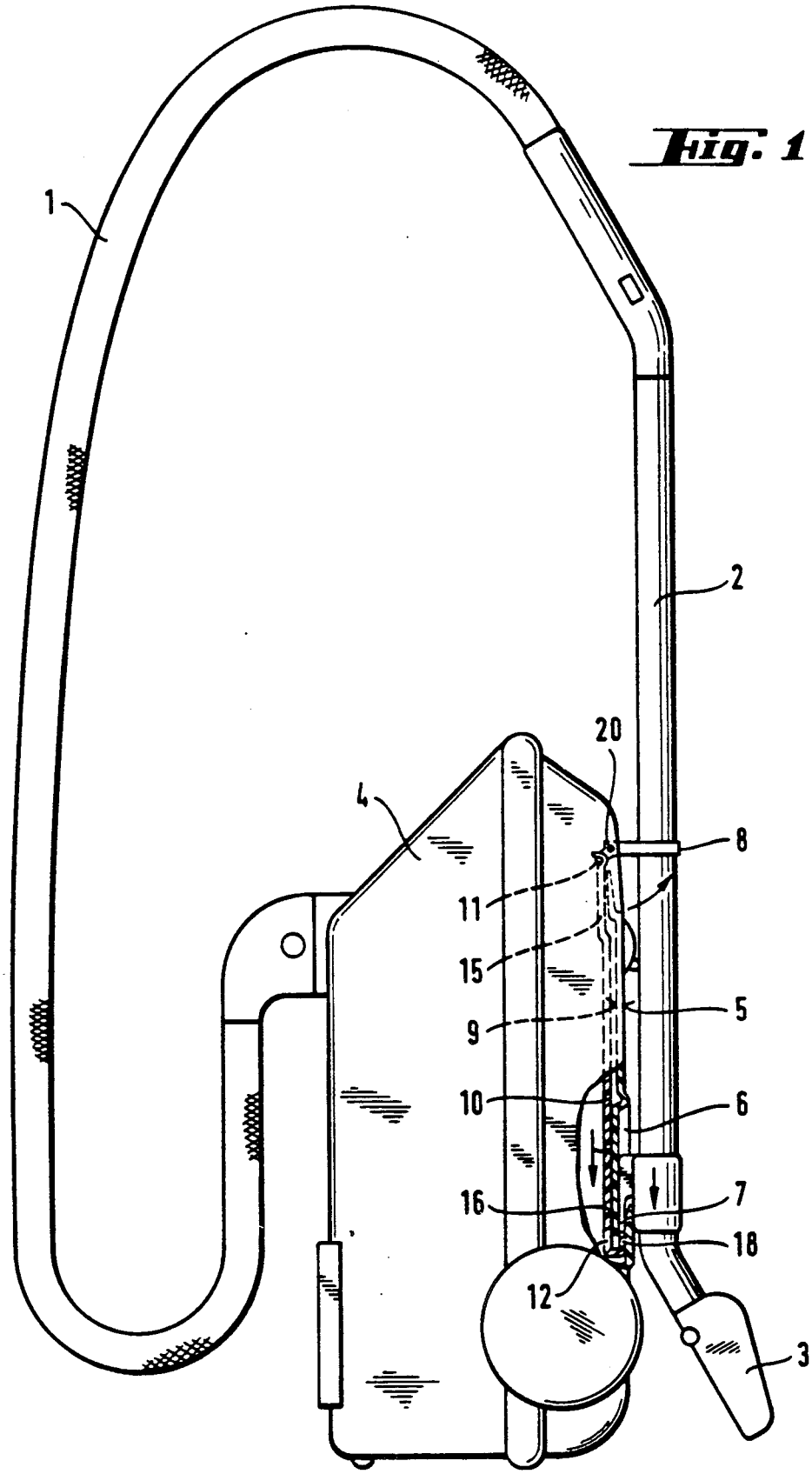
FIG. 1 shows a vacuum cleaner pursuant to the invention with a suction tube nozzle unit attached thereto.
Figure 2:
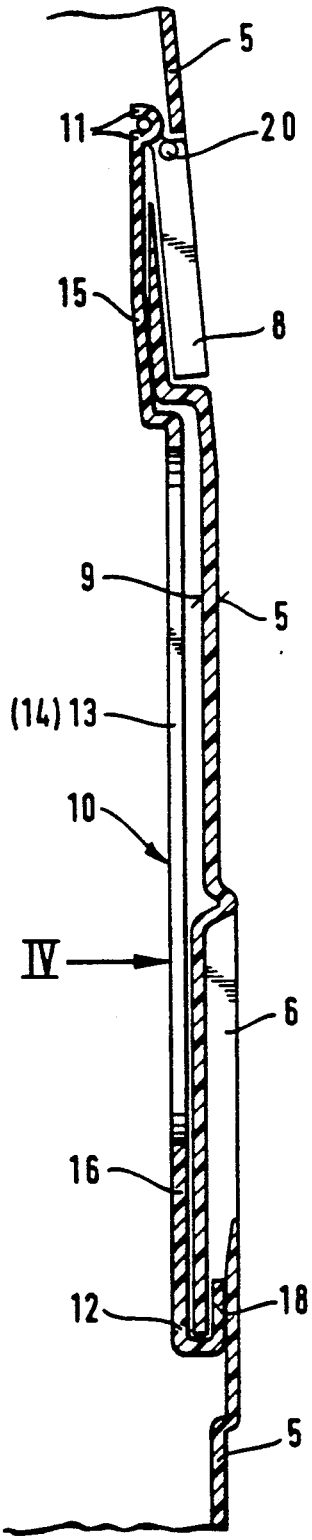
FIG. 2 shows the retaining means according to the invention with the retaining clip pivoted inward.

FIG. 1 shows the vacuum cleaner according to the invention in a resting position, with the suction tube nozzle unit consisting of a suction hose 1, a suction tube 2 and a suction nozzle 3 secured in retaining means mounted on the vacuum cleaner housing 4. The retaining means consist of a retaining recess or depression 6 formed in the base 5 of the housing, so as to accommodate a hook 7 provided on the suction tube 2, and a pivotable retaining clip 8 articulated to the base 5 of the housing about an axis 20, for clipping the suction tube 2. A spring arm 10 is movably mounted on the inner wall 9 of the vacuum cleaner housing 4. One end 11 of the spring arm 10 is hinged to the retaining clip 8 and the other end 12 engages in the retaining recess 6. The spring arm 10 is constructed in one piece and consists of two springs 13 and 14, two plates 15 and 16 and a resiliently deformable holder 17. The end 12 of the spring arm 10 is bent in the region of the retaining recess and engages in the retaining recess 6. A press key 18 is formed on the bent end 12 of the spring arm 10. Cams 19 are provided on the holder 17 so as to cooperate with eyelets (not shown) provided on the inner wall 9 of the vacuum cleaner housing 4, so as to secure the spring arm 10 to the inner wall 9. Pin ·' which engage in the eyelets are provided on the cams 19 to retain the spring arm 10 at the inner wall 9. The ends of the holder 17 are attached to the housing by the pins 19' while the central portion of the holder 17 and the remainder of the spring arm are movable due to the resilience of the holder material.

Figure 3:
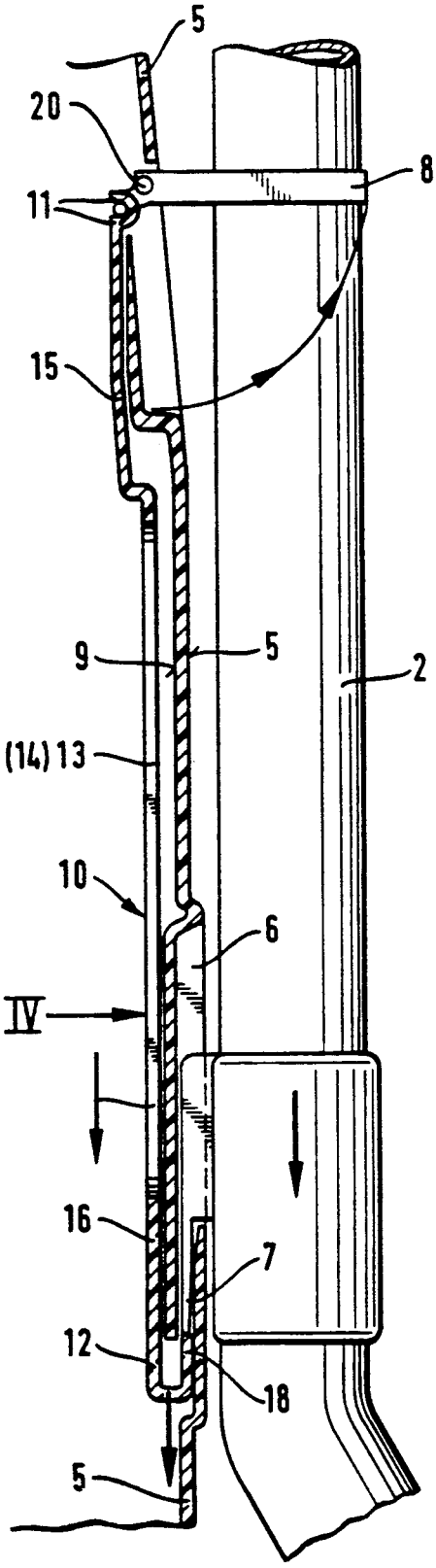
FIG. 3 shows the retaining means according to the invention with the retaining clip pivoted outward and engaging a suction nozzle.
Figure 4:
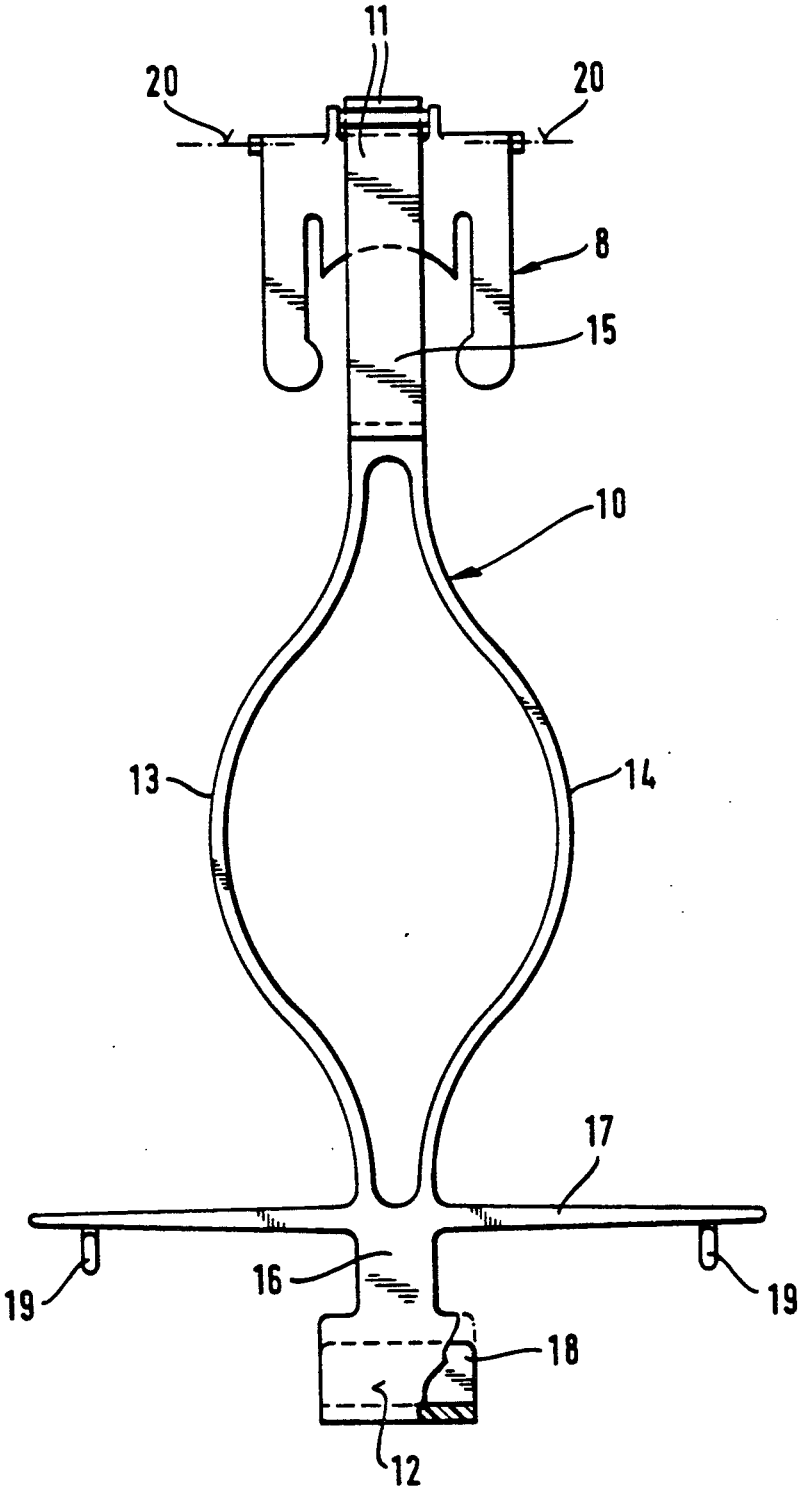
FIG. 4 shows the spring arm according to the invention.
Figure 5:
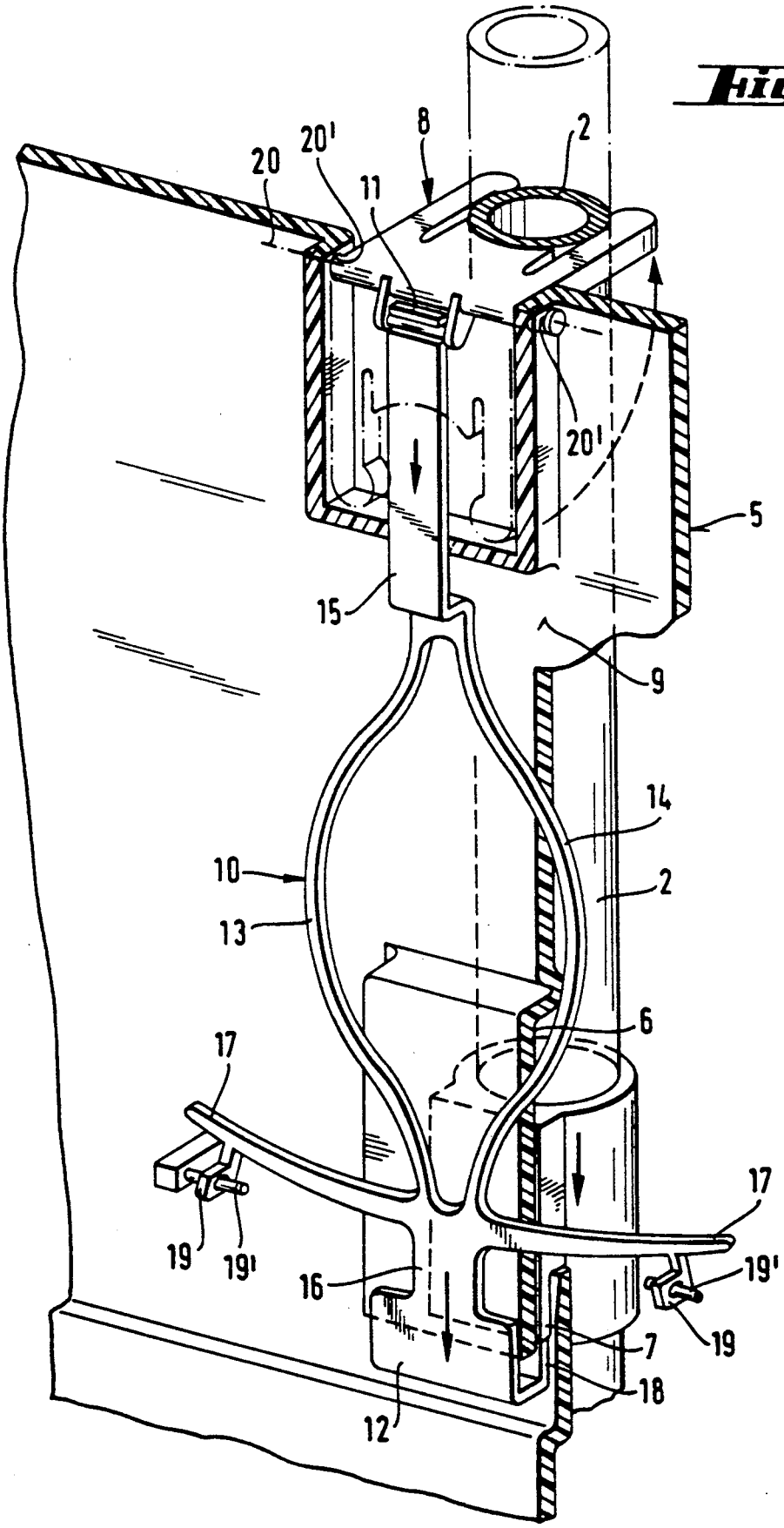
FIG. 5 shows the spring arm mounted to the housing of the vacuum cleaner.

When the hook 7 mounted on the suction tube 2 is manually inserted in the retaining recess 6 provided on the vacuum cleaner housing 4, the hook 7 engages and pushes a press key 18 formed on the spring arm 10. The force of the hook 7 causes the spring arm 10 mounted on the inner wall 9 of the vacuum cleaner housing 4 to move in the direction of the arrow (FIG. 3), while the holder 17, mounted on the spring arm 10 at right angles to the direction of movement, is tensioned as a result of its resilience. The end 11 of the spring arm 10 is hinged to the retaining clip 8 which is pivoted into the operating position by the spring arm 10. When the hook 7 is removed from the retaining recess 6, the operative connection between the hook 7 and spring arm 10 is broken and the tension in the spring arm 10 and a holder 17 is freed, so that the spring arm is moved back into its starting position and at the same time pivots the retaining clip 8 hinged thereto into its resting position.

While the invention has been illustrated and described as embodiment in an electrical vacuum cleaner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. A holder for a suction tube nozzle unit of an electrical vacuum cleaner having a vacuum cleaner housing, the suction tube nozzle unit including a suction hose, a suction tube and a suction nozzle, the holder comprising:

a pivotable retaining clip for the suction tube articulated to the housing;

a hook mounted on one of the suction tube and the suction nozzle;

a recess formed in the housing so as to accept said hook;

a spring arm (10) movably mounted on an inner wall (9) of the vacuum cleaner housing (4), the spring arm (10) having a first end (11) hinged to the retaining clip (8), and a second end (12) operatively engageable with and movable by the hook (7) in the retaining recess (6) so that engagement of the hook with the second end of the spring arm moves the spring arm so as to cause the first end of the spring arm to pull down on said pivotable retaining clip and pivot said clip into a position perpendicular to the wall of the housing; and resiliently deformable connecting arms (17) mounted on the spring arm (10) substantially at right angles to a direction of movement of the spring arm parallel to the inner wall of the housing along an axis running between the first end and second end of the spring arm, the connecting arms (17) having ends attached to the housing so that a tensile force is generated in the holder connecting arms (17) when the spring arm (10) is engaged and moved by the hook (7), the spring arm (10) and the connecting arms (17) having a recoil force which is less than a force exertable by the hook (7) on the spring arm (10), said recoil force causing said spring arm to move, when said hook is disengaged from said second end of said spring arm, so that said spring arm pushes upon on said retaining clip and pivots said clip into a position parallel to the housing wall.

2. A holder according to claim 1, wherein the spring arm (10) is a one-piece member consisting of two plates (15 and 16) at its ends, separated by at least one spring (13).

3. A holder according to claim 1, wherein the spring arm (10) and connecting arms (17) are formed as one piece.

4. A holder according to claim 1, wherein the spring arm (10) is bent at its second end (12) in the region of the retaining recess (6), so that the bend second end (12) of the spring arm (10) engages in the retaining recess (6), a press key (18) being formed on the bend second end (12).

* * * * *